US010087700B2

(12) United States Patent
Holland, Jr.

(10) Patent No.: US 10,087,700 B2
(45) Date of Patent: Oct. 2, 2018

(54) MULTI-CAVITY BLOWOUT PREVENTER

(71) Applicant: Axon EP, Inc., Houston, TX (US)

(72) Inventor: William Rinehart Holland, Jr., Houston, TX (US)

(73) Assignee: Axon Pressure Products, Inc., Houston, TX (US)

( * ) Notice: Subject to any disclaimer, the term of this patent is extended or adjusted under 35 U.S.C. 154(b) by 466 days.

(21) Appl. No.: 14/735,448

(22) Filed: Jun. 10, 2015

(65) Prior Publication Data

US 2015/0361755 A1 Dec. 17, 2015

Related U.S. Application Data

(60) Provisional application No. 62/010,701, filed on Jun. 11, 2014.

(51) Int. Cl.
*E21B 33/06* (2006.01)

(52) U.S. Cl.
CPC ..... *E21B 33/062* (2013.01)

(58) Field of Classification Search
CPC ..... E21B 33/062; E21B 33/06; E21B 33/063; E21B 33/064
See application file for complete search history.

(56) References Cited

U.S. PATENT DOCUMENTS

| | | | | |
|---|---|---|---|---|
| 2,132,037 | A * | 10/1938 | MacClatchie | E21B 33/062 251/1.3 |
| 2,139,525 | A * | 12/1938 | Snell | E21B 33/062 251/1.3 |
| 2,159,541 | A * | 5/1939 | MacClatchie | E21B 33/062 175/214 |
| 3,917,293 | A * | 11/1975 | Lewis | E21B 33/06 251/1.2 |
| 4,043,389 | A * | 8/1977 | Cobb | E21B 29/08 166/55 |
| 6,176,466 | B1 * | 1/2001 | Lam | E21B 33/06 137/613 |
| 6,845,959 | B2 * | 1/2005 | Berckenhoff | E21B 33/063 166/85.4 |
| 2014/0021382 | A1 * | 1/2014 | Jurena | E21B 33/062 251/1.3 |
| 2016/0053565 | A1 * | 2/2016 | Dhuet | E21B 33/063 166/339 |

* cited by examiner

*Primary Examiner* — James G Sayre
(74) *Attorney, Agent, or Firm* — Baker Botts L.L.P.

(57) ABSTRACT

An improved multi-cavity blowout preventer is disclosed. The improved multi-cavity blowout preventer includes a first cavity and a first actuator assembly coupled to the first cavity. A second cavity is disposed adjacent to the first cavity and a second actuator assembly is coupled to the second cavity. The second cavity is disposed at an angular offset from the first cavity.

16 Claims, 19 Drawing Sheets

FIG. 4C
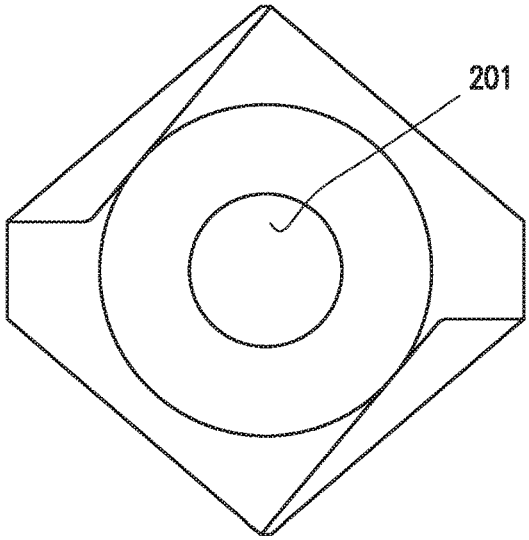
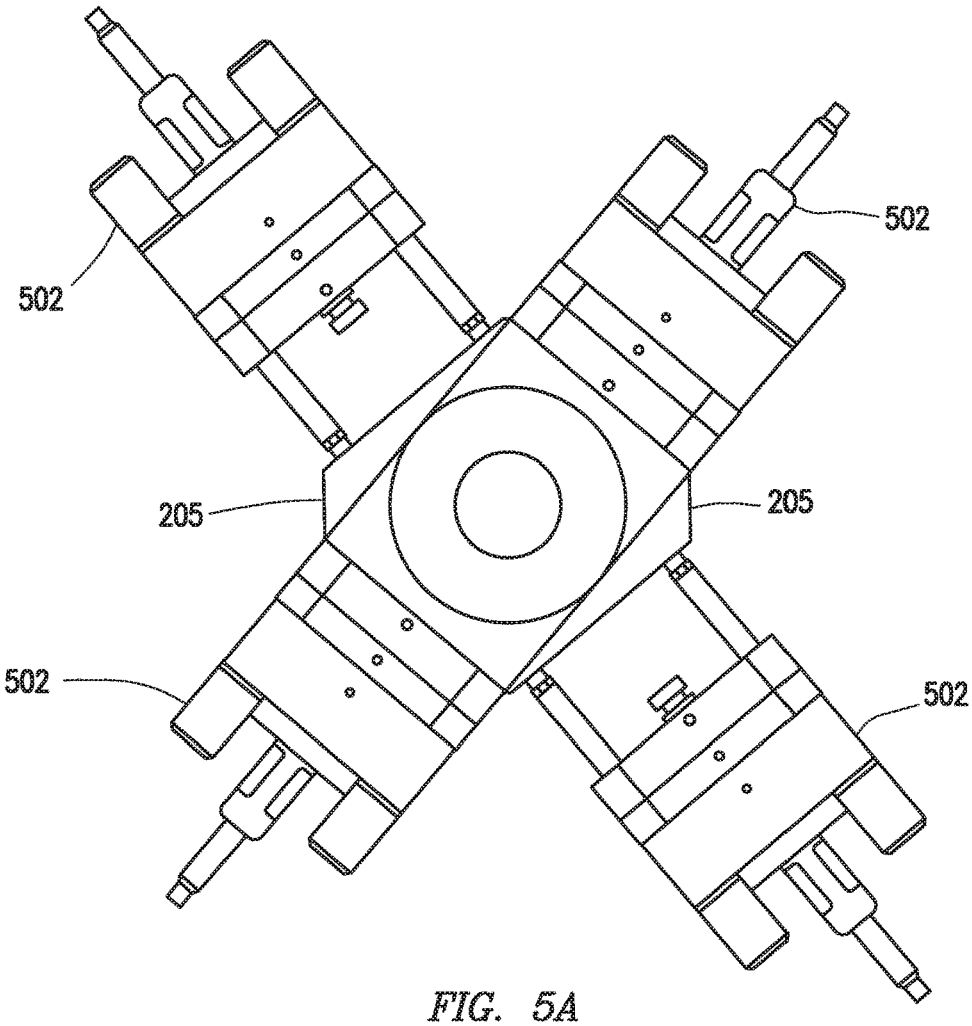
FIG. 5A

FIG. 7
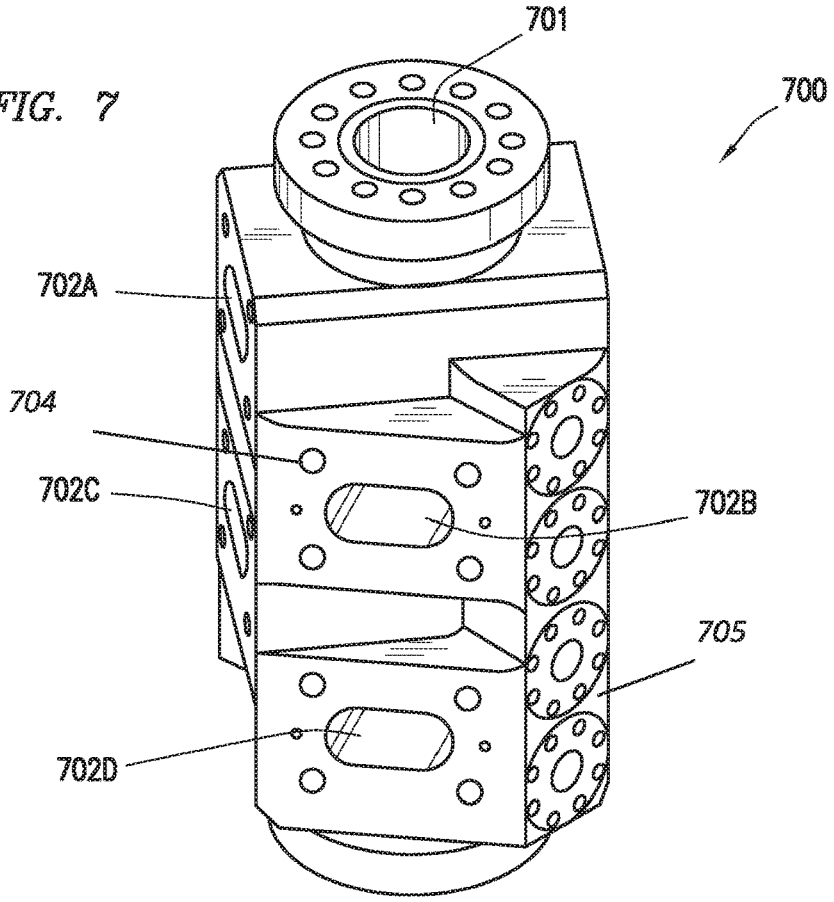
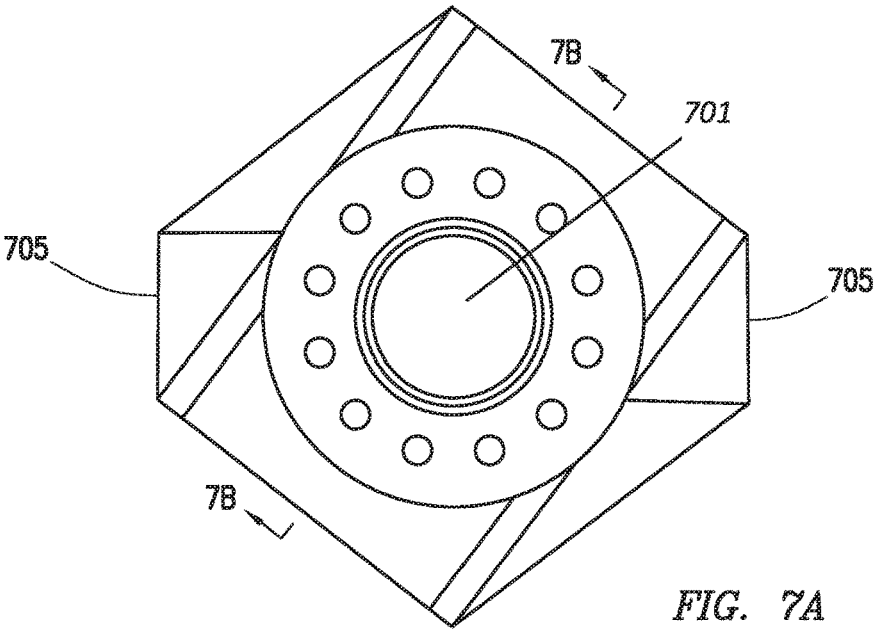
FIG. 7A

FIG. 8A
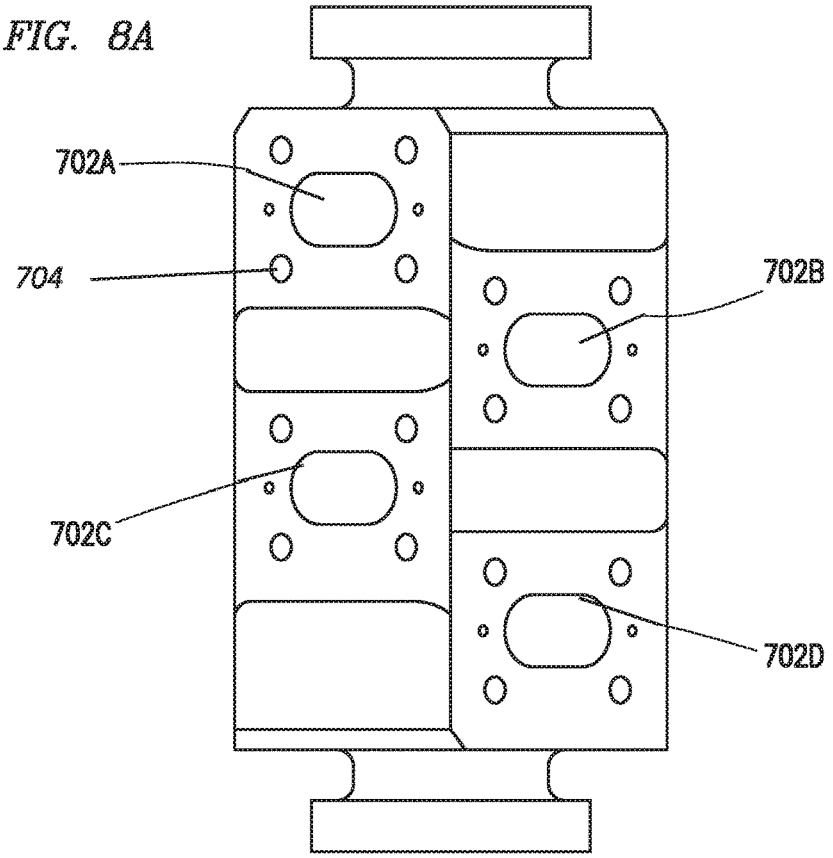
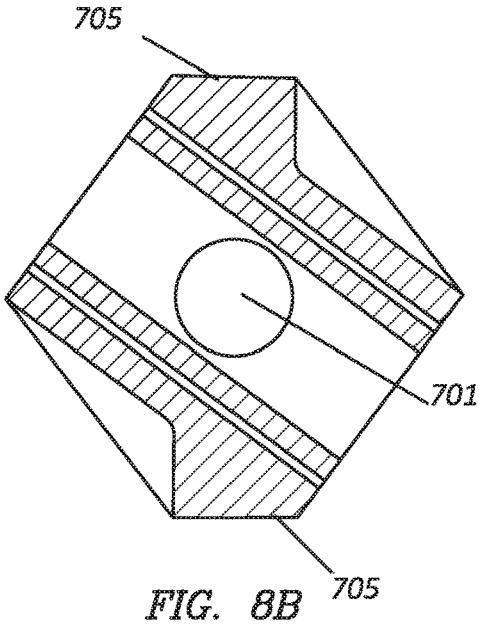
FIG. 8B

MULTI-CAVITY BLOWOUT PREVENTER

This applications claims priority to U.S. Provisional Application Ser. No. 62/010,701 filed on Jun. 11, 2014 which is incorporated by reference herein in its entirety.

FIELD OF INVENTION

The present disclosure relates generally to improved methods and systems for extracting hydrocarbons from a subterranean formation and more particularly, to an improved multi-cavity blowout preventer.

BACKGROUND

Blowout preventers are used extensively throughout the oil and gas industry in order to prevent undesirable fluid flow from the wellbore through the wellhead. The two categories of blowout preventers that are most prevalent are ram blowout preventers and annular blowout preventers. Blowout preventer stacks frequently utilize both types, typically with at least one annular blowout preventer stacked above several ram blowout preventers. Accordingly, typical blowout preventers may comprise a main body to which various types of ram units may be attached. The ram units in ram blowout preventers allow for both the shearing of the drill pipe and the sealing of the blowout preventer. Typically, a blowout preventer stack may be secured to a wellhead and may provide a safe means for sealing the well in the event of a system failure.

In certain implementations, the ram blowout preventers may be a Multi-Cavity Ram Blowout Preventer ("MCRBOP") having a plurality of cavities to allow for implementing one or more ram blowout preventers as discussed in further detail below. It is desirable to develop an MCRBOP which occupies less space but can still effectively perform all desired functions.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features.

FIG. 4C shows a bottom view of the improved MCRBOP of FIG. 2A along the dotted line "C".

FIGS. 5A, 5B, and 5C depict a top view and two perspective views of the improved MCRBOP of FIG. 2, with actuator assemblies coupled thereto at each cavity.

FIG. 7 depicts an MCRBOP in accordance with another illustrative embodiment of the present disclosure.

FIG. 7A depicts a top view of the MCRBOP of FIG. 7.

FIGS. 8 and 8A depict opposing side views of the improved MCRBOP of FIG. 7.

FIGS. 8B and 8C depict a cross sectional view of the improved MCRBOP of FIG. 8 along the dotted lines "B" and "C".

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present disclosure relates generally to improved methods and systems for extracting hydrocarbons from a subterranean formation and more particularly, to an improved multi-cavity blowout preventer.

The terms "couple" or "couples" as used herein are intended to mean either an indirect or a direct connection. Thus, if a first device couples to a second device, that connection may be through a direct connection or through an indirect mechanical or electrical connection via other devices and connections.

Illustrative embodiments of the present disclosure are described in detail herein. In the interest of clarity, not all features of an actual implementation may be described in this specification. It will of course be appreciated that in the development of any such actual embodiment, numerous implementation-specific decisions are made to achieve the specific implementation goals, which will vary from one implementation to another. Moreover, it will be appreciated that such a development effort might be complex and time-consuming, but would nevertheless be a routine undertaking for those of ordinary skill in the art having the benefit of the present disclosure.

To facilitate a better understanding of the present disclosure, the following examples of certain embodiments are given. In no way should the following examples be read to limit, or define, the scope of the disclosure.

Figure 1:
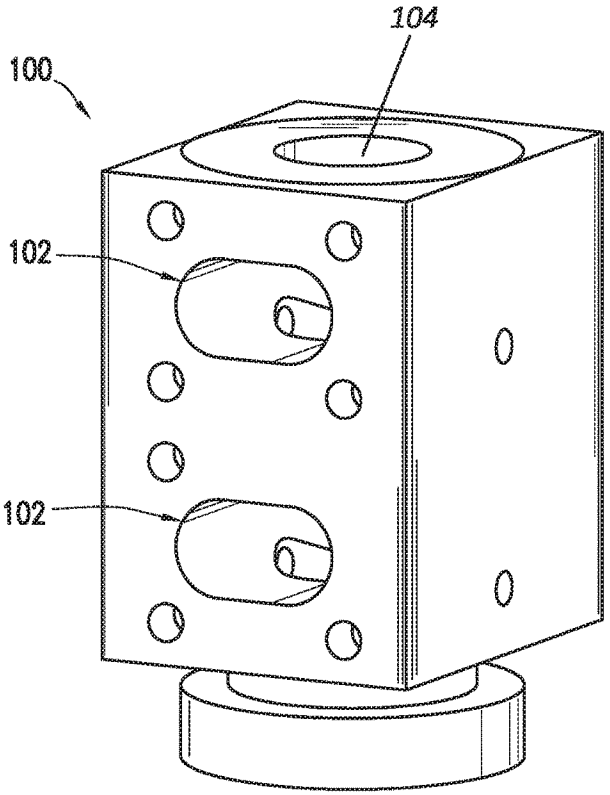
FIG. 1 (PRIOR ART)
FIG. 1 is an MCRBOP in accordance with the prior art.

FIG. 1 depicts a typical MCRBOP in accordance with the prior art which is denoted generally with reference numeral 100. As shown in FIG. 1, in a typical MCRBOP 100, two or more cavities 102 are disposed inline with each other. In operation, the housing 100 may be coupled to a wellhead and a tubing (e.g., a drill pipe) may be inserted into the housing 100 through the bore 104 and into the wellhead (not shown). A blind ram, a pipe ram or a shear ram blowout preventer may be coupled to each of the cavities 102.

Figure 1A:
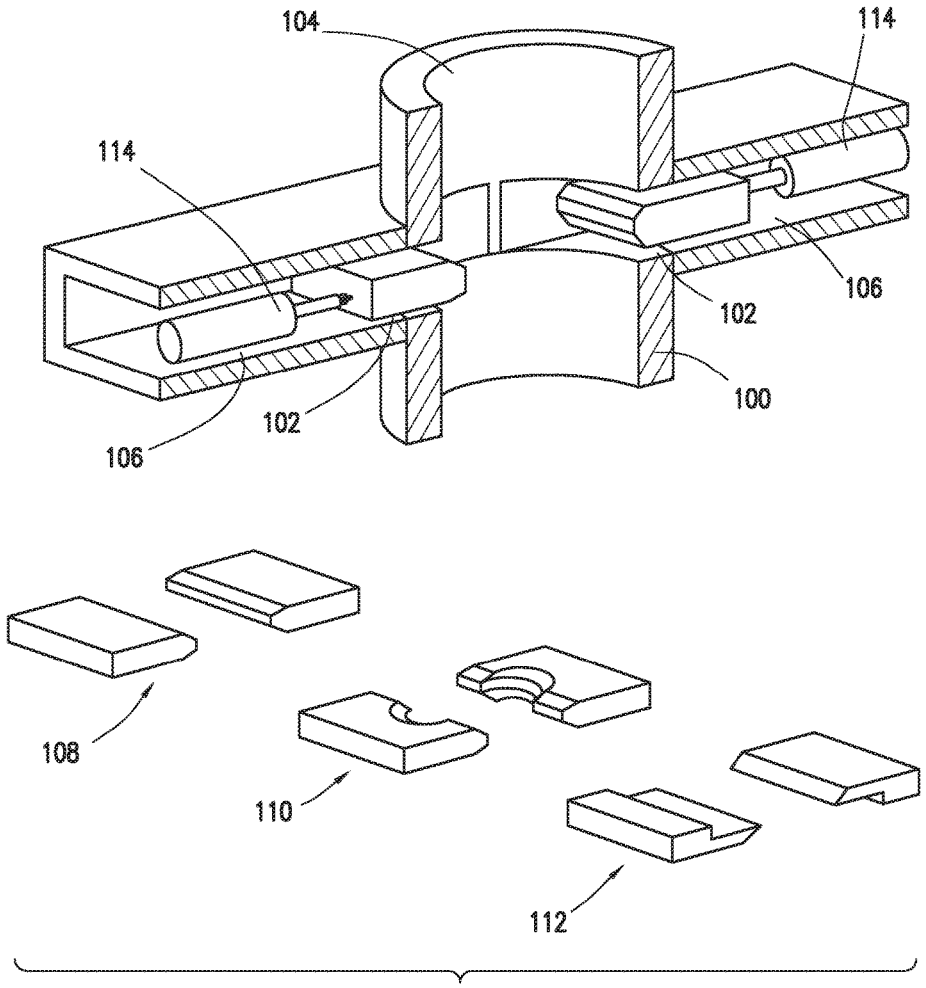
FIG. 1A depicts three different types of rams that may be utilized in an MCRBOP.

FIG. 1A depicts the three different types of rams that may be utilized in an MCRBOP. Specifically, the rams may be coupled to the housing 100 through the cavities 102. The rams may then be movable through guide chambers 106 extending transversely from the bore 104. The rams may be movable between an inner position disposed in the bore 104 and an outer position removed from the bore 104.

Depending on user preferences, the rams may have different profiles as shown in FIG. 1A. In certain implementations the rams may be blind rams 108 (also known as "sealing rams") which have no openings to mate with a tubing. Blind rams 108 may be used to seal the wellbore when the well contains no tubing. In certain implementations when a tubing is disposed within the wellbore it may be desirable to use a pipe ram 110. In its inner position, a pipe ram 110 closes around a tubing (e.g., a drill pipe) disposed through the bore 104 in the wellbore. Accordingly, the pipe ram 110 restricts flow in the annulus between the outside of the tubing and the wellbore without obstructing fluid flow through the tubing. Finally, in certain implementations, it may be desirable to restrict flow through the tubular disposed in the bore 104. In such implementations a shear ram 112 may be used. A shear ram 112 is designed to cut through the tubing disposed in the bore 104 to restrict fluid flow therethrough. Specifically, the inner ends of the shear rams 112 may include blades to shear the tubing disposed in the bore 104 and seals which may be flat or otherwise complimentary for sealing across the open bore after the tubing is sheared. Accordingly, once the shear rams 112 are moved to their inner position within the bore 104 the sealing engagement between the seals of the shear rams 112 effectively terminates any fluid flow through the bore. The rams may be moved between their inner and outer position using an actuator such as, for example, a hydraulically actuated cylinder 114 having a piston coupled to the rams.

The structure and operation of different types of rams are well known to those of ordinary skill in the art, having the benefit of the present disclosure and will therefore not be discussed in detail herein. As would be appreciated by those of ordinary skill in the art, having the benefit of the present disclosure, the blind ram 108, the pipe ram 110 and the shear ram 112 depicted in FIG. 1A are illustrative examples only and the present disclosure is not limited to any specific configuration of the rams. Accordingly, other ram configurations may be implemented without departing from the scope of the present disclosure.

Figure 2:
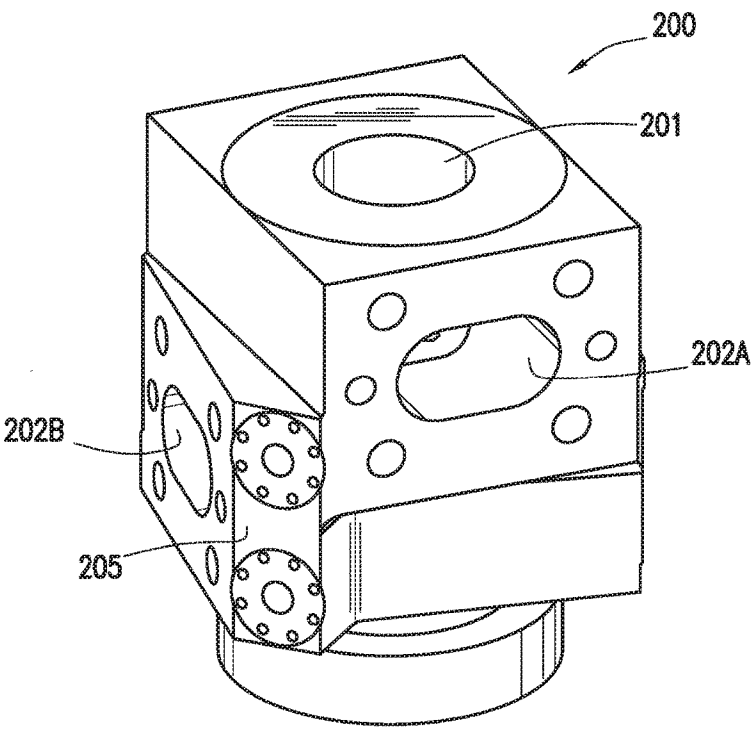
FIG. 2 is an MCRBOP in accordance with a first embodiment of the present disclosure.

Turning now to FIG. 2, an improved MCRBOP in accordance with a first illustrative embodiment of the present disclosure is denoted generally with reference numeral 200. As shown in FIG. 2, the MCRBOP 200 is depicted with a bore 201 disposed in the vertical direction. In this embodiment, two cavities 202A, 202B are disposed at an angular offset from each other around the bore 201. Although two cavities are depicted in FIG. 2, the present disclosure it not limited to any particular number of cavities. Accordingly, any number of cavities may be included without departing from the scope of the present disclosure.

Figure 2B:
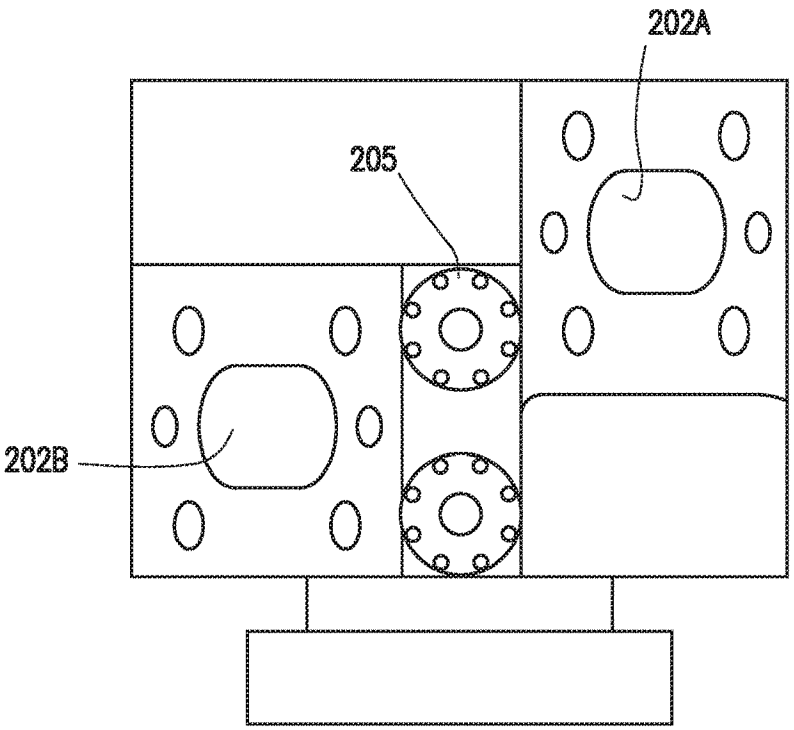
FIGS. 2A and 2B depict a side view of the improved MCRBOP of FIG. 2 from two opposing sides.
Figure 2A:
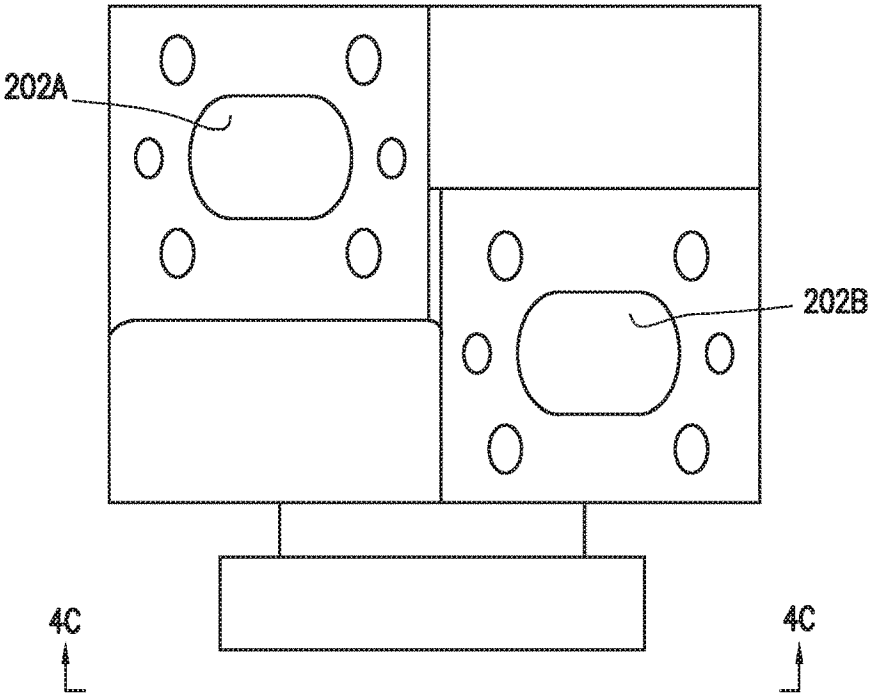

The offset design of the improved MCRBOP 200 allows the cavities 202A, 202B to be closer to each other along the axis of the bore 201 than the cavities 102 of a prior art MCRBOP 100. By disposing the cavities 202A, 202B at an angular offset from one another the MCRBOP 200 achieves a more compact design as shown in FIG. 2. As a result the MCRBOP 200 body can be shorter and lighter than a traditional MCRBOP 100, without sacrificing safety or performance. FIGS. 2A and 2B depict a side view of the improved MCRBOP 200 from two opposing corners of FIG. 2 depicting the two ends of each cavity 202A and 202B. On the side shown in FIG. 2A the two cavities 202A, 202B are disposed adjacent to each other. In contrast, on the opposing side, the two cavities 202A, 202B are spaced apart by an offset wall 205. In this manner, the cavities 202A and 202B are angularly offset from each other. The angular offset between any two adjacent cavities 202 of the MCRBOP 200 may be from approximately 0° to approximately 90° or in certain implementations from approximately 30° to approximately 90°.

Figure 4:
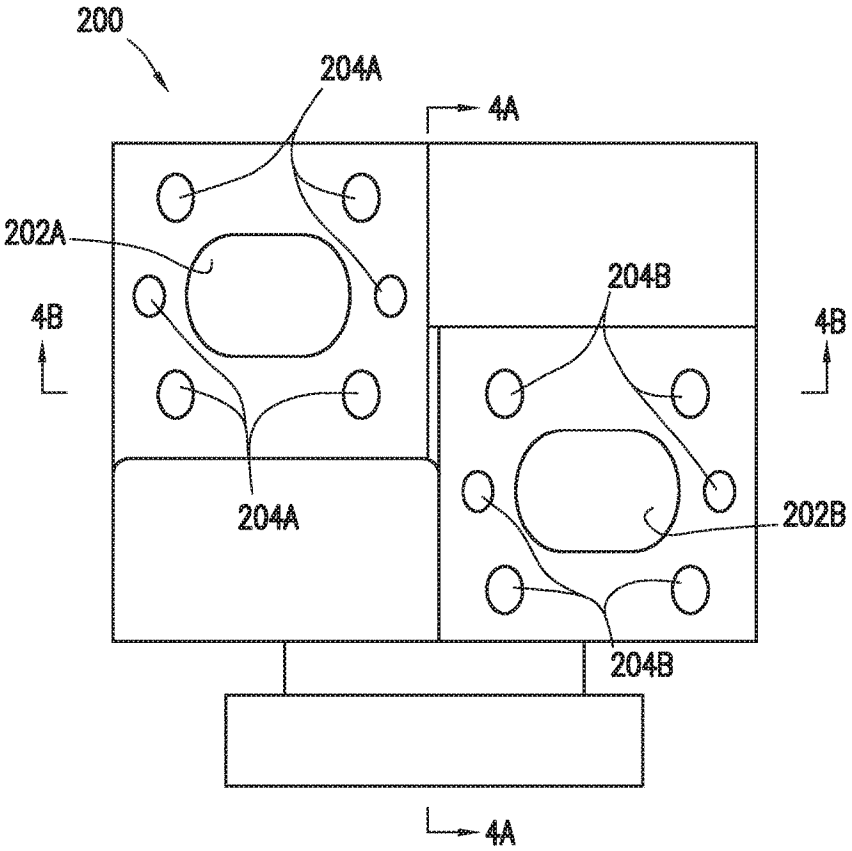
FIG. 4 depicts a side view of the improved MCRBOP of FIG. 2.
Figure 3:
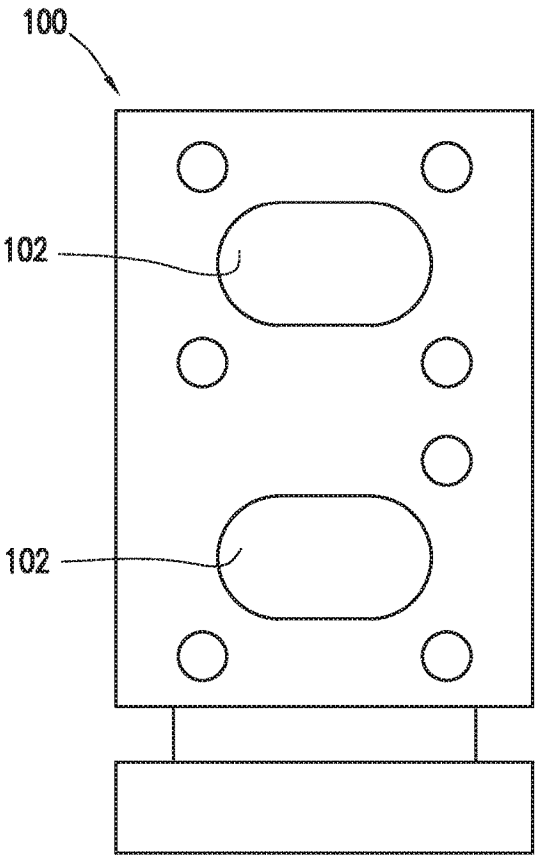
FIG. 3 (PRIOR ART)
FIG. 3 depicts a side view of the MCRBOP of FIG. 1.

FIGS. 3 and 4 depict a side view of a traditional MCRBOP 100 (as shown in FIG. 1) and an MCRBOP 200 in accordance with an illustrative embodiment of the present disclosure, respectively. As shown in FIGS. 3 and 4, because of the angular disposition of its cavities 202A, 202B the improved MCRBOP 200 is shorter and uses less material than the traditional MCRBOP 100. Additionally, as shown in FIG. 4, one or more connections 204A, 204B allow the MCRBOP cavities 202A, 202B to be coupled to other components as known to those of ordinary skill in the art, having the benefit of the present disclosure. For instance, an actuator assembly may be coupled to the cavities 202A, 202B using the connections 204A, 204B.

The angular offset between the cavities 202A, 202B allows the cavities to be closer to each other along the axis of the bore 201. Specifically, unlike the prior art configuration of FIG. 1, in accordance with embodiments of the improved MCRBOP 200 disclosed herein, some of the connections 204A of the first cavity and some of the connections 204B of the second cavity may be disposed at the same axial location along the bore 201 as shown in FIG. 4. Additionally, the improved compact design of the MCRBOP 200 facilitates a more effective device operation by allowing the rams disposed at the different cavities 202 to be proximate to one another and at an angular offset. For instance, in certain implementations, a pipe ram may be coupled to the cavity 202B and a shear ram may be coupled to the cavity 202A. The pipe ram may first be activated and may provide a seal around the tubing disposed in the bore 201. The shear ram may then be activated to shear the tubing and completely seal fluid flow through the bore 201. The angular offset between the pipe ram and the shear ram more effectively centers the tubing during this process.

Figure 4B:
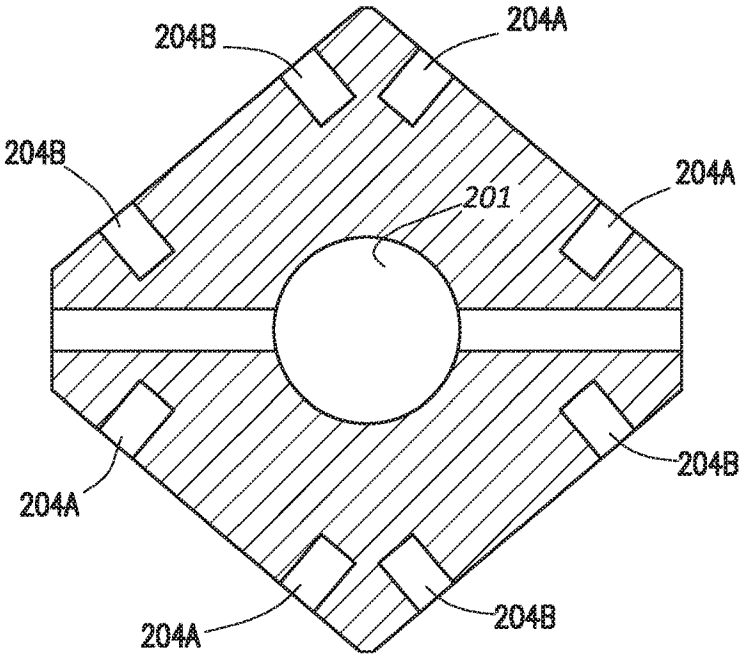
FIG. 4B depicts a bottom view of the improved MCRBOP of FIG. 4 along the dotted line "B".
Figure 4A:
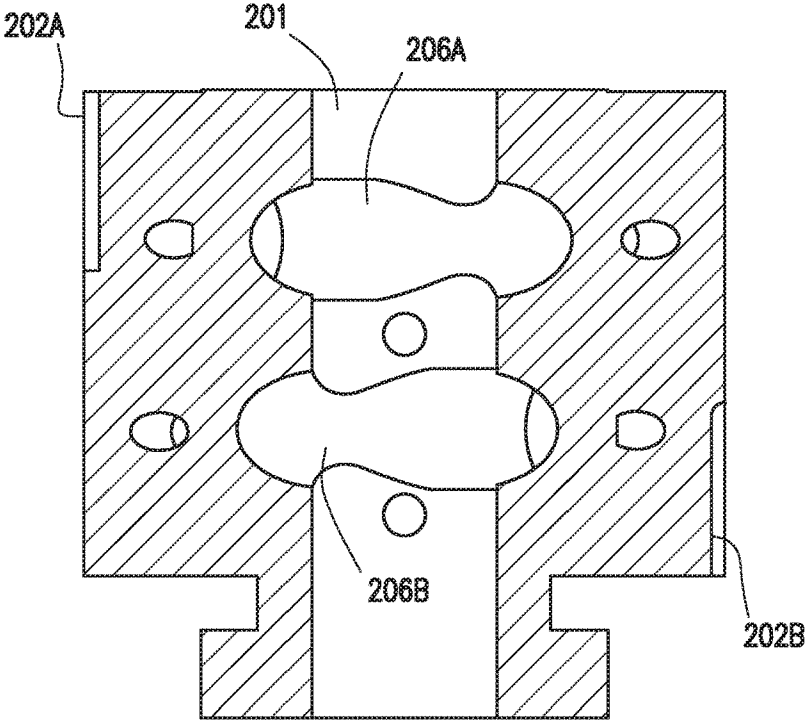
FIG. 4A depicts a cross-sectional view of the improved MCRBOP of FIG. 4 along the dotted line "A".

FIG. 4A depicts a cross-sectional view of the improved MCRBOP 200 of FIG. 4 along the dotted line "A" and FIG. 4B depicts a bottom view of the MCRBOP 200 along the dotted line "B" of FIG. 4. FIG. 4C shows a bottom view of the improved MCRBOP 200 of FIG. 2A along the dotted line "C", depicting the bore 201 and the disposition of the offset cavities 202A, 202B. As shown in FIG. 4A, each cavity 202A, 202B is coupled to a corresponding ram guide chamber 206A, 206B, respectively. As with the cavities 202A, 202B, the ram guide chambers 206A, 206B are disposed at an angular offset relative to each other.

Figure 5B:
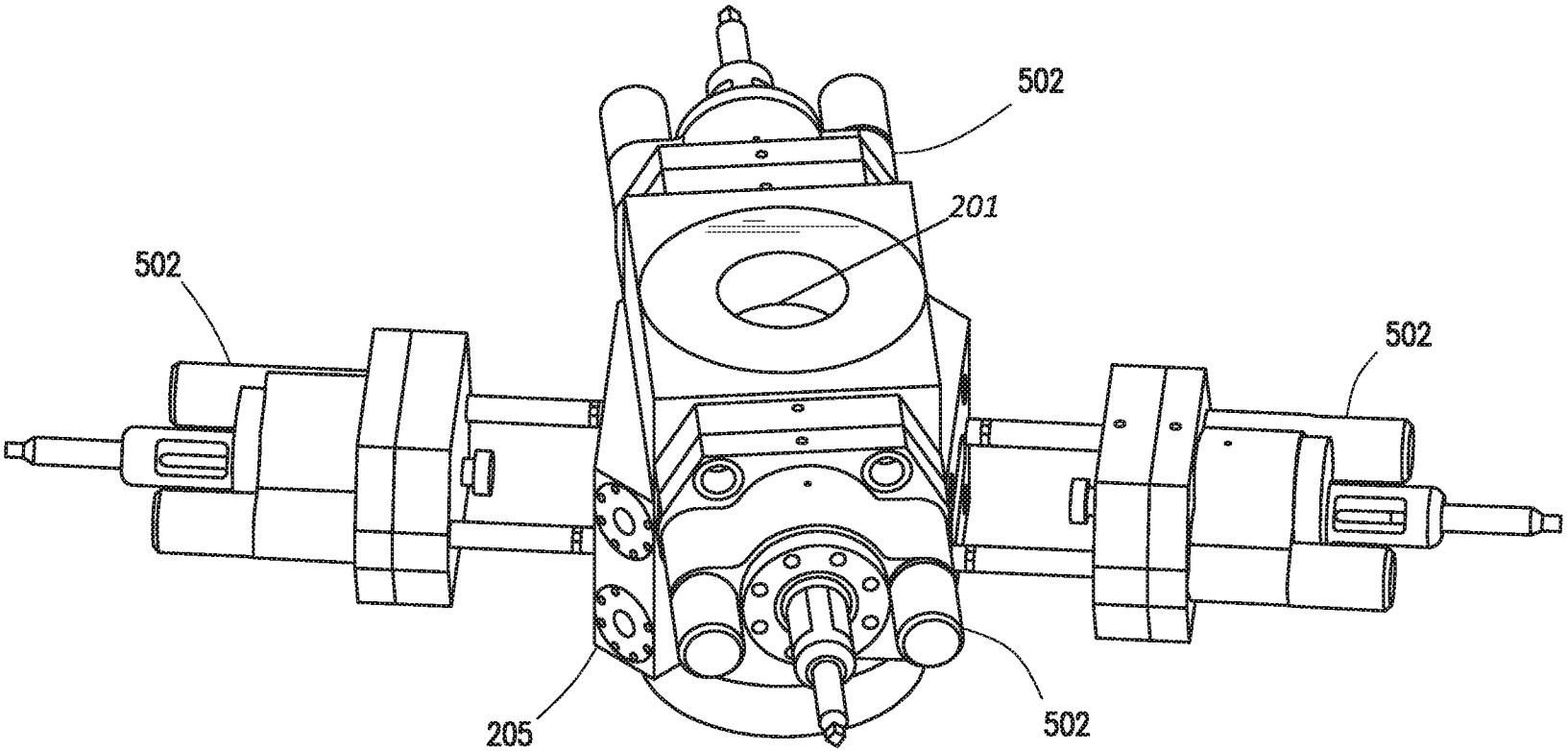
Figure 5C:
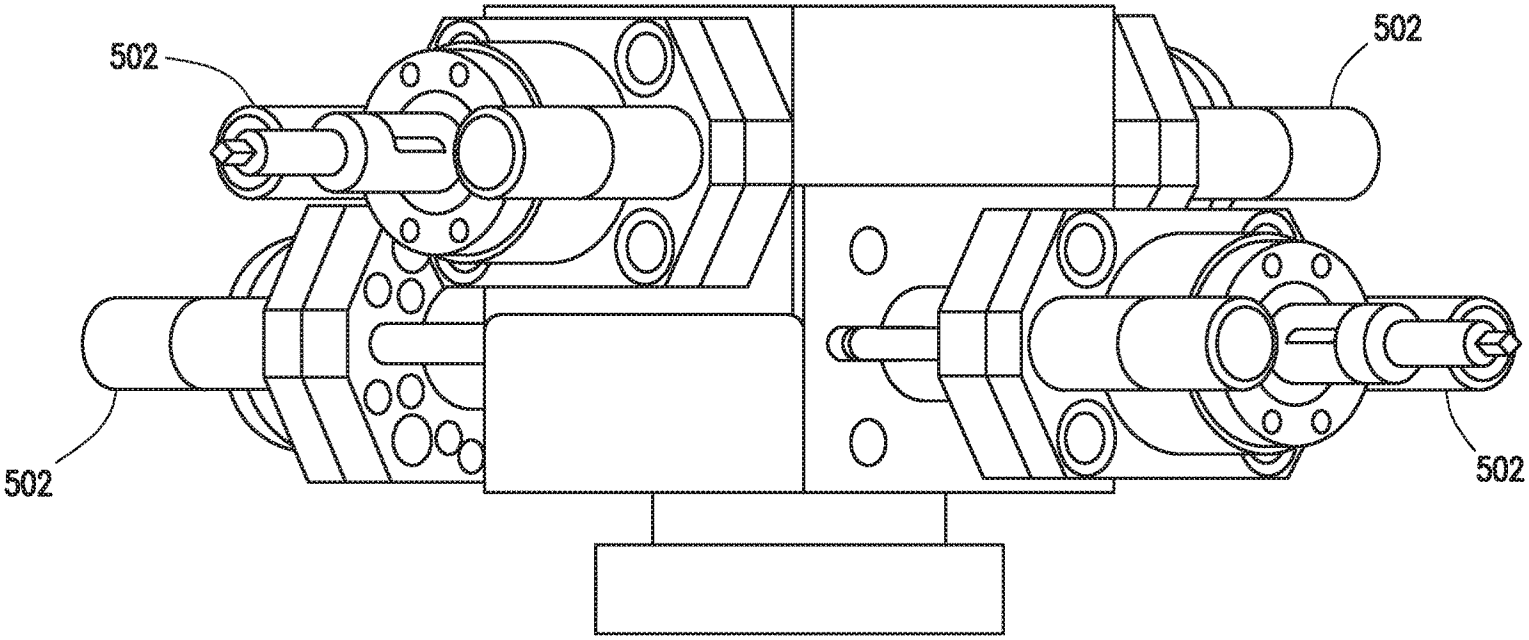

FIGS. 5A, 5B, and 5C depict a top view and two perspective views of the improved MCRBOP 200 of FIG. 2, with actuator assemblies 502 coupled thereto at each cavity 202A, 202B. As shown in FIGS. 5A, 5B and 5C, connections 204A, 204B may be used to couple each actuator assembly 502 to a corresponding cavity 202A, 202B. As discussed above, the actuator assemblies 502 may be used to move the rams (blind rams, pipe rams, or shear rams) between the inner position (within the bore 201) and the outer position (outside the bore 201). The structure and operation of the actuator assemblies 502 is known to those of ordinary skill in the art, having the benefit of the present disclosure, and will therefore not be discussed in detail herein.

Figure 6:
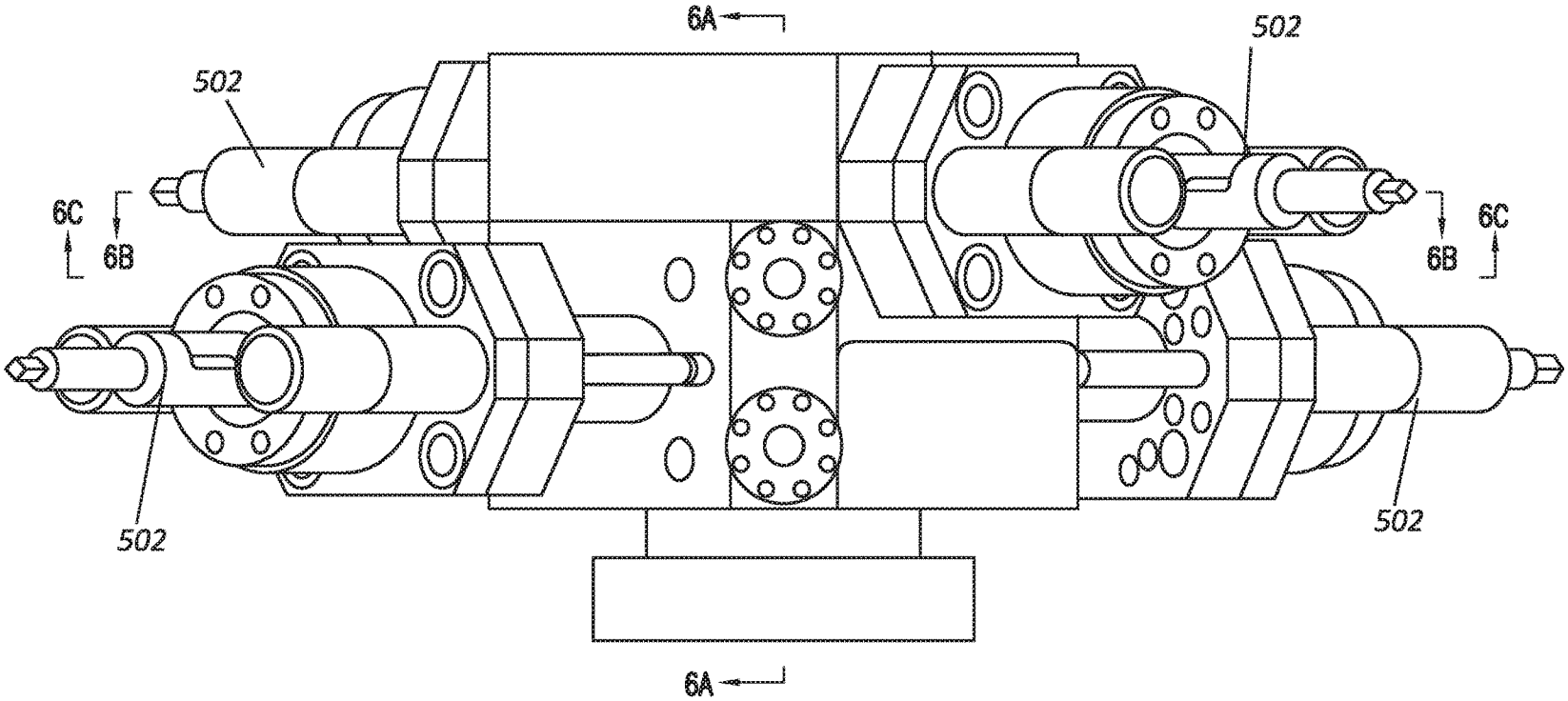
FIG. 6 depicts another perspective view of the improved MCRBOP of FIG. 2 with actuator assemblies attached to each cavity.
Figure 6A:
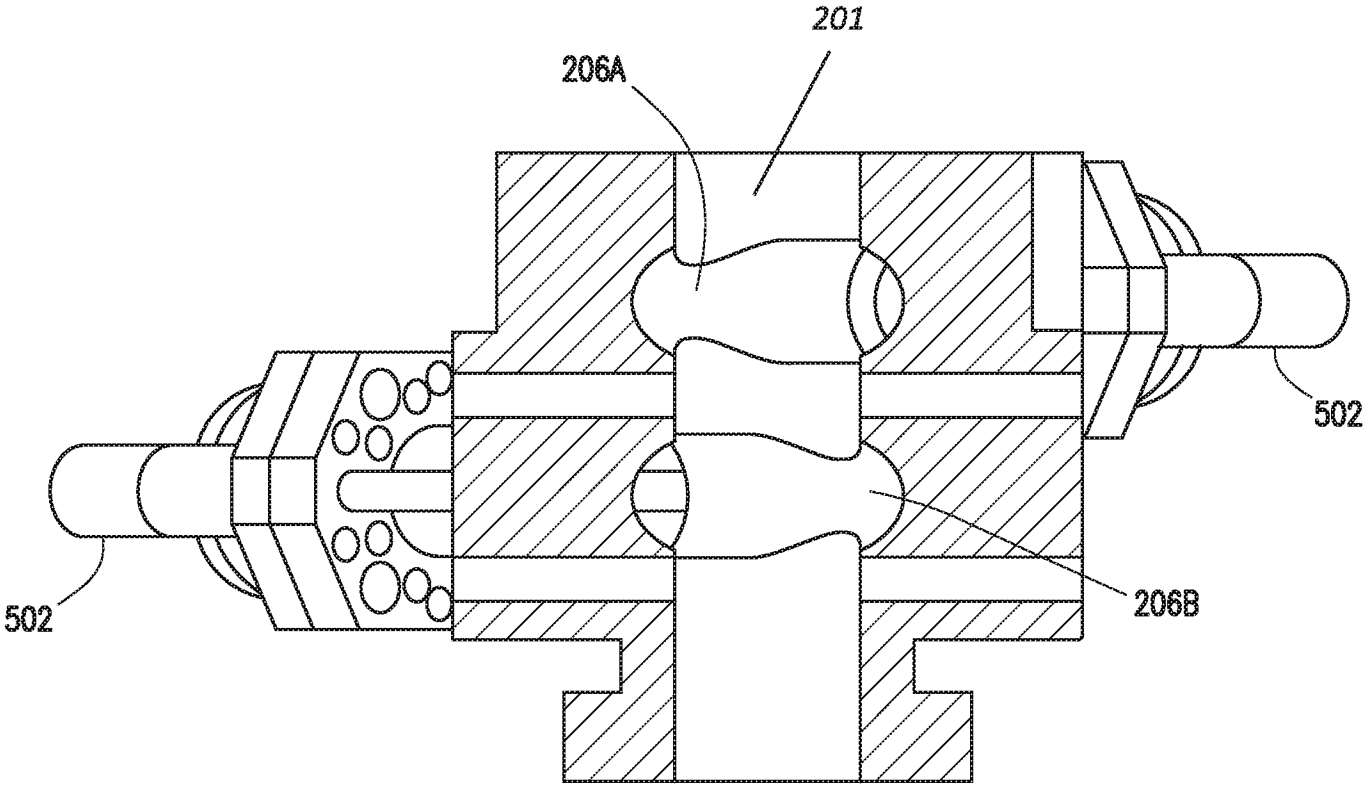
FIGS. 6A, 6B, and 6C depict cross-sectional views of the MCRBOP of FIG. 6 along the dotted lines "A", "B" and "C", respectively, with the actuator assemblies attached thereto.
Figure 6B:
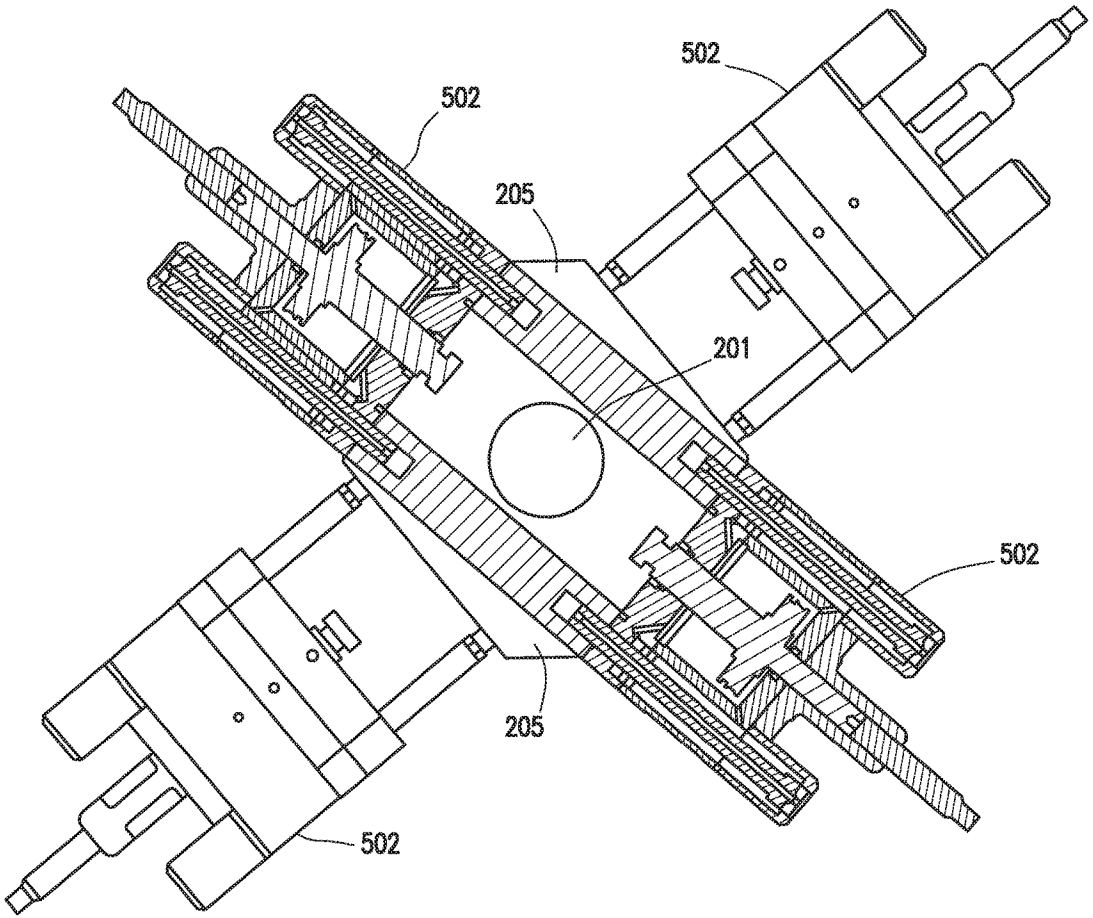
Figure 6C:
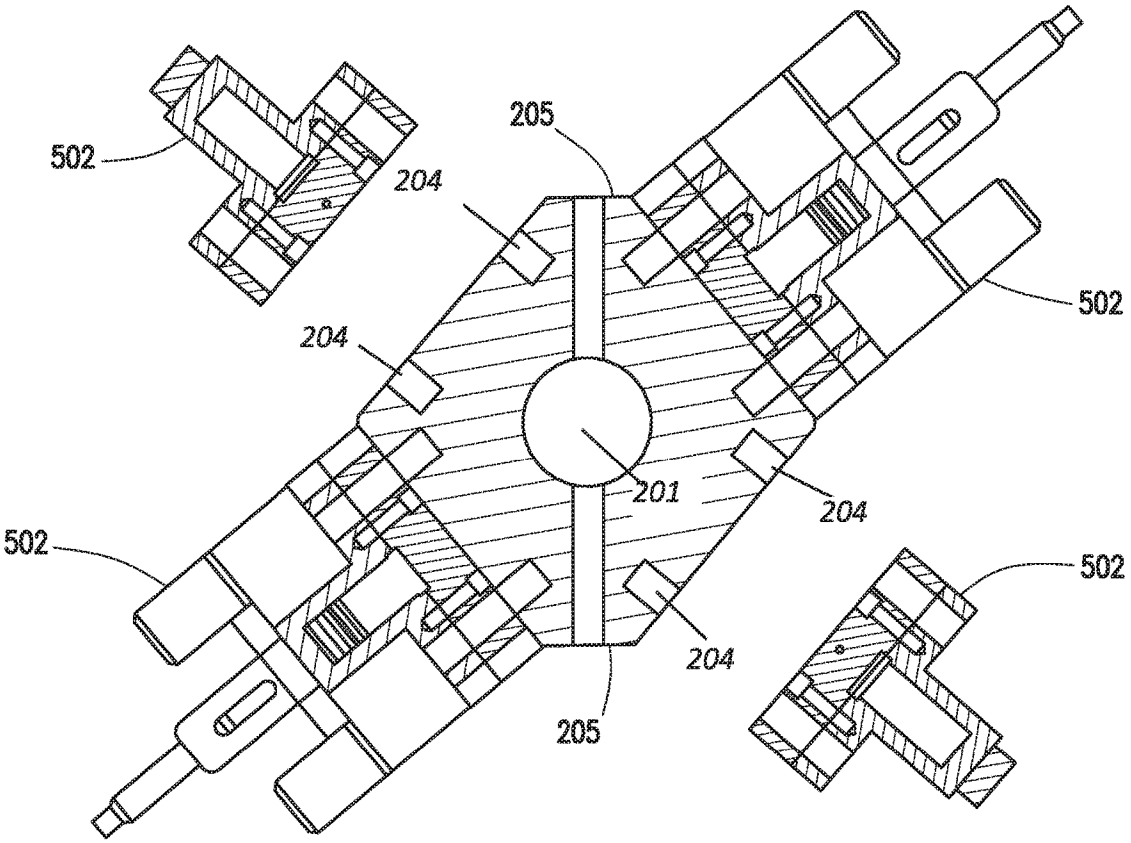

FIG. 6 depicts another perspective view of the improved MCRBOP 200 of FIG. 2 with actuator assemblies 502 attached to each cavity 202A, 202B. FIGS. 6A, 6B, and 6C depict cross-sectional views of the MCRBOP 200 of FIG. 6 along the dotted lines "A", "B" and "C", respectively, with the actuator assemblies 502 attached thereto.

Figure 7B:
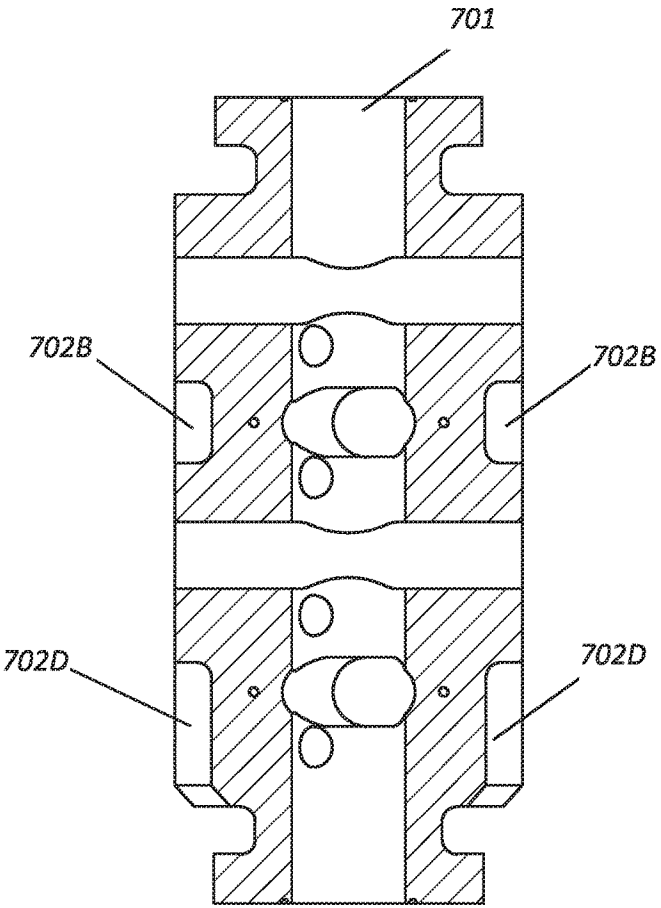
FIG. 7B depicts a cross-sectional view of the MCRBOP of FIG. 7 along the line "B" of FIG. 7A.

FIG. 7 depicts an MCRBOP 700 in accordance with another illustrative embodiment of the present disclosure. In this embodiment, the MCRBOP 700 includes four cavities 702A-D. As with the first embodiment, an offset wall 705 is disposed at one corner of the MCRBOP 700 and the cavities 702A-D are disposed at an angular offset from each other. One or more connections 704 allow the MCRBOP cavities 702A-D to be coupled to other components such as an actuator assembly as discussed above in conjunction with FIG. 5. FIG. 7A depicts a top view of the MCRBOP 700 of FIG. 7 and FIG. 7B depicts a cross-sectional view of the MCRBOP 700 along the line B of FIG. 7A.

Figure 8:
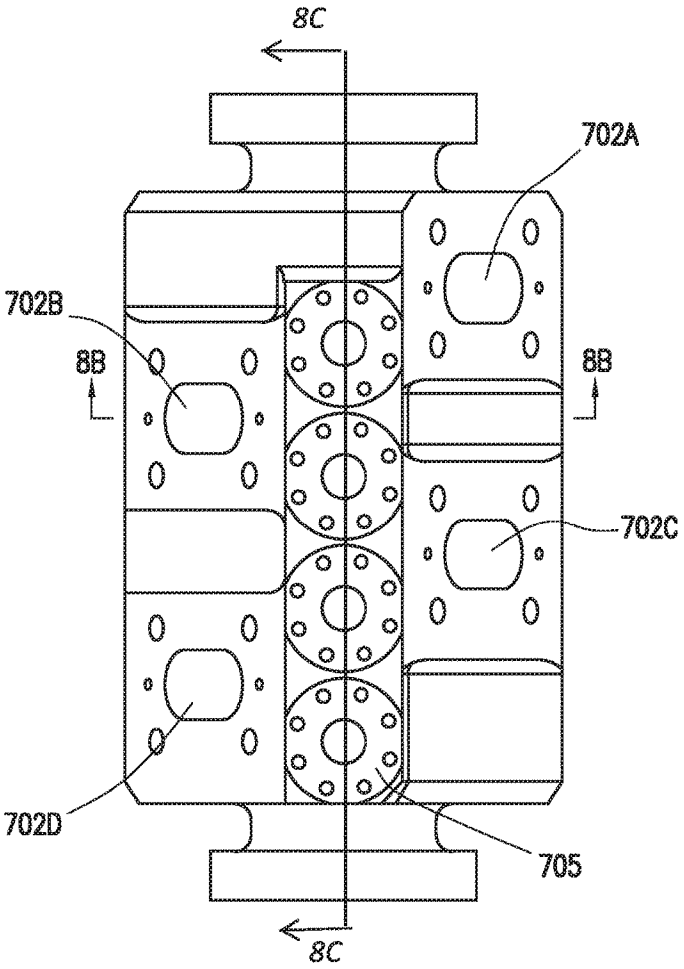
Figure 8C:
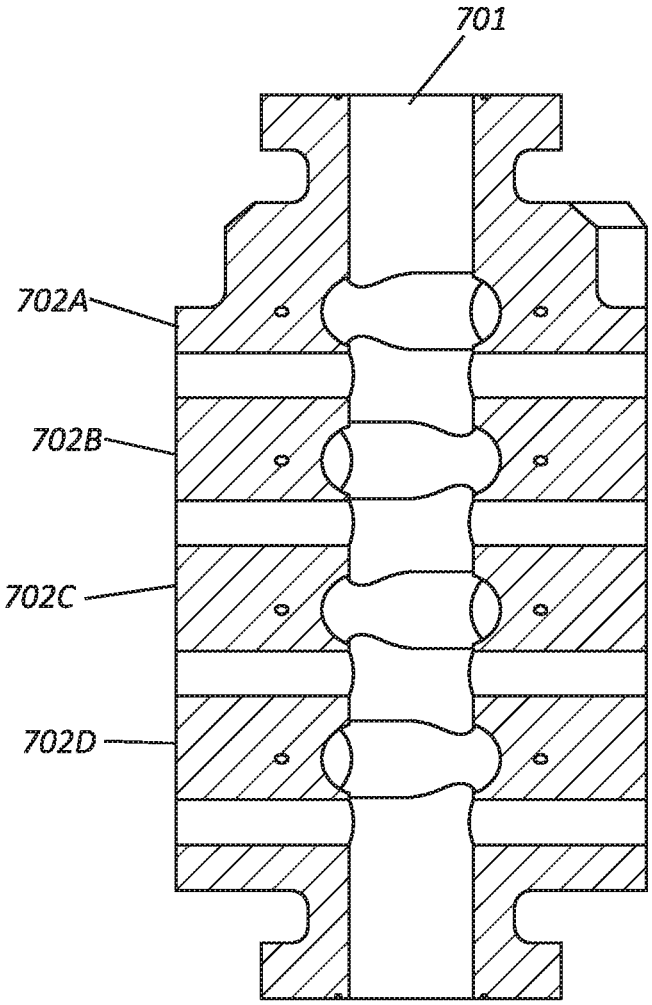

FIGS. 8 and 8A depict side views of the MCRBOP 700 of FIG. 7 from the two opposing corners thereof. As shown in FIG. 8, on one side, the offset wall 705 is disposed between the adjacent cavities 702. FIGS. 8B and 8C depict a cross sectional view of the improved MCRBOP 700 of FIG. 8 along the dotted lines "B" and "C".

Figure 9:
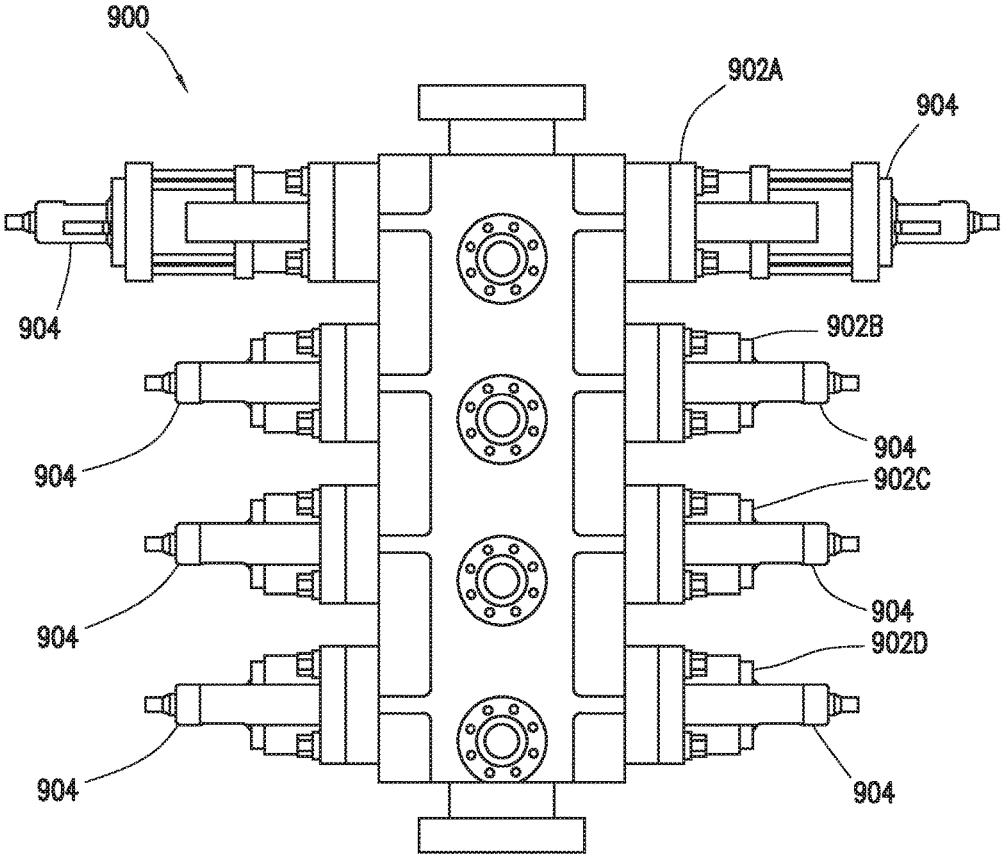
FIG. 9 (PRIOR ART)
FIG. 9 depicts an MCRBOP in accordance with the prior art having four cavities coupled to actuator assemblies.
Figure 10A:
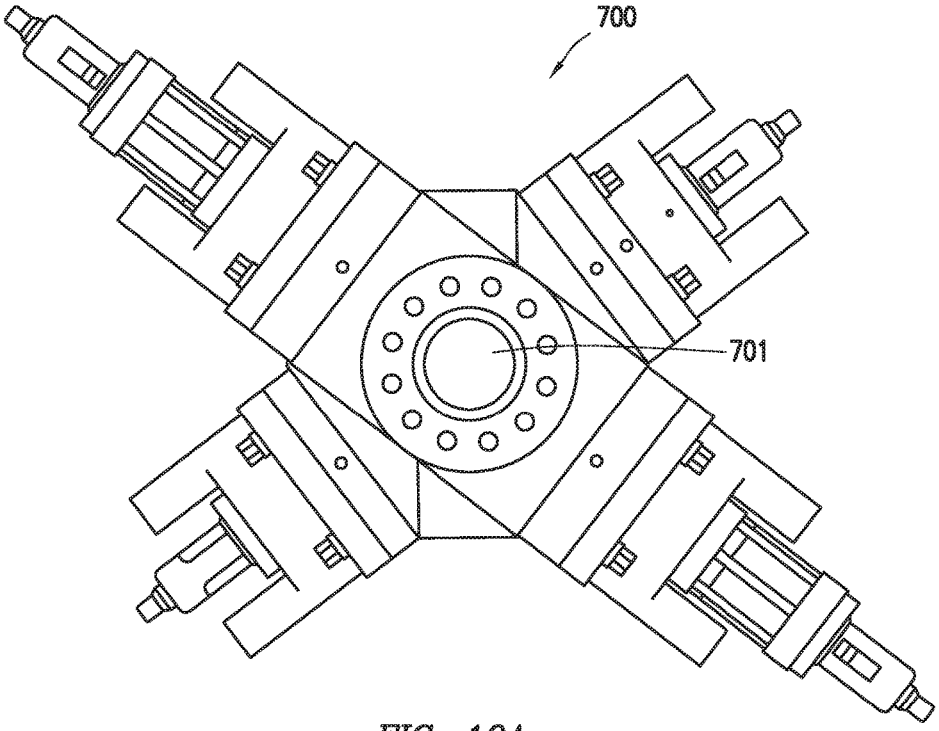
FIG. 10A depicts a top view of the MCRBOP of FIG. 10.
Figure 10:
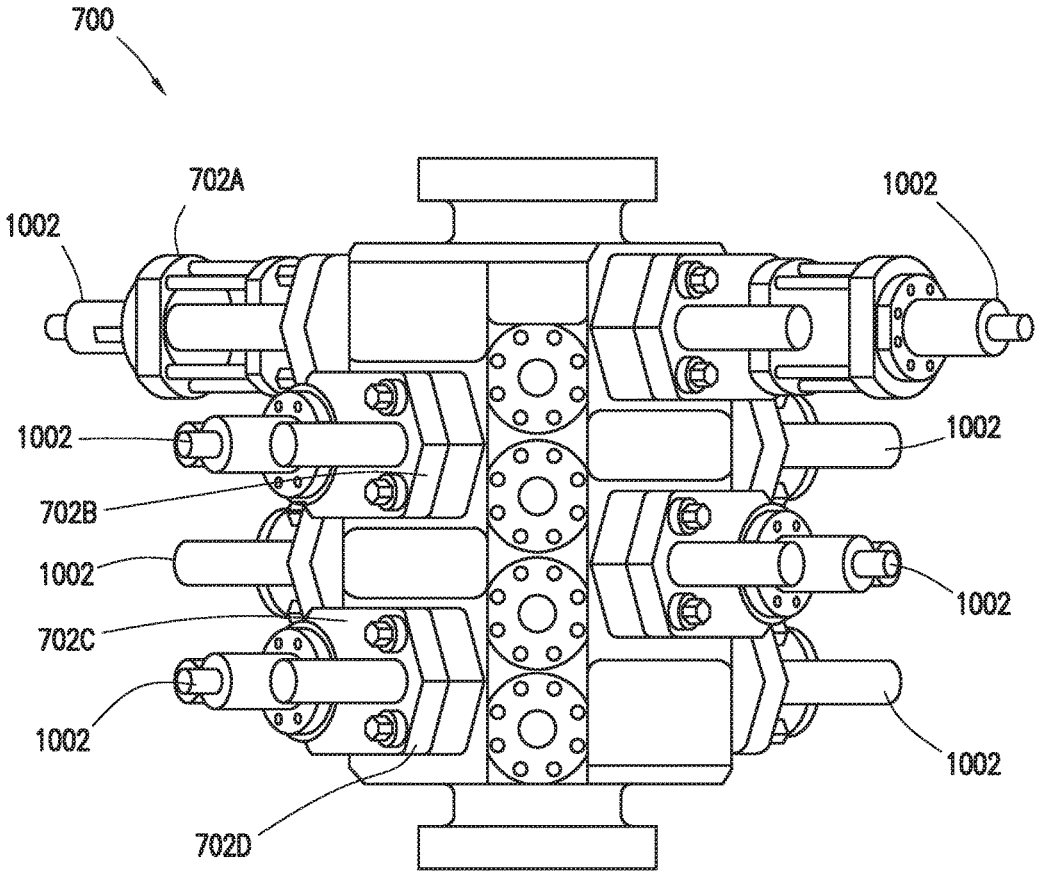
FIG. 10 depicts an improved MCRBOP in accordance with an embodiment of the present disclosure having four cavities coupled to actuator assemblies.

FIGS. 9 and 10 depict an MCRBOP 900 in accordance with the prior art and the MCRBOP 700 of FIG. 7, respectively. Each of the MCRBOPs shown in FIGS. 9 and 10 includes four set of cavities that are coupled to a corresponding actuator assembly 1002. Specifically, MCRBOP 900 includes four sets of cavities 902A-D coupled to actuator assemblies 904. Similarly, as shown in FIG. 10, actuator assemblies 1002 are coupled to the cavities 702A-D of the MCRBOP 700.

As shown in FIGS. 9 and 10, the cavities 702A-D of the improved MCRBOP 700 are disposed at an angular offset relative to each other. Accordingly, the improved MCRBOP 700 facilitates the use of the same number of cavities 702A-D as the prior art MCRBOP 900 in a more compact, space saving implementation.

Figure 9A:
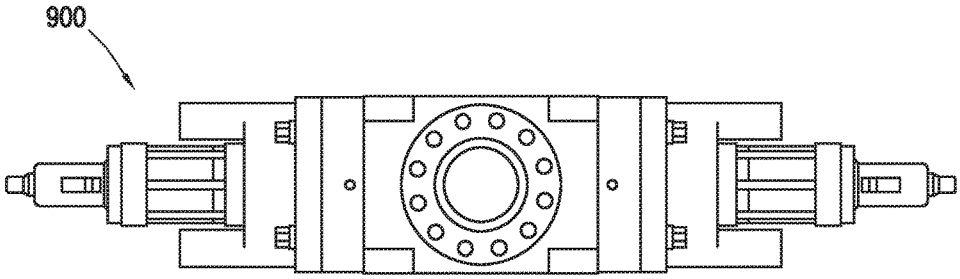
FIG. 9A (PRIOR ART)
FIG. 9A depicts a top view of the MCRBOP of FIG. 9.

FIGS. 9A and 10A depict a top view of the MCRBOPs 900 and 700 of FIGS. 9 and 10, respectively. As shown in FIGS. 9 and 9A, in a traditional MCRBOP 900 the cavities 902A-D are aligned. In contrast, as shown in FIGS. 10 and 10A, the cavities 702A-D of the improved MCRBOP 700 are disposed at an angular offset relative to each other. For instance, each cavity 702 may be disposed at an angular offset of from approximately 0° to approximately 90° or in certain implementations from approximately 30° to approximately 90° compared to its adjacent cavity. However, this angular offset is depicted and discussed as an illustrative example. As would be appreciated by those of ordinary skill in the art, having the benefit of the present disclosure, the cavities 702 may be disposed at any desirable angular offset relative to one another without departing from the scope of the present disclosure.

Any desirable combination of rams may be coupled to an MCRBOP in accordance with illustrative embodiments of the present disclosure. For instance, in certain implementations, three pipe rams and a shear ram may be coupled to the MCRBOP 700 of FIG. 7 having four cavities (702A-D) and actuator assemblies 1002 coupled to each cavity. The improved offset design of the MCRBOP 700 allows the rams to be proximate to one another along the bore 701 and at an angular offset. With the rams located proximate to each other and at an angular offset, the pipe rams can more effectively center the pipe when sealing the annulus and the shear ram can then shear the tubing to completely seal the bore 701.

Although a specific number of cavities are depicted in the illustrative embodiments disclosed herein, the present disclosure it not limited to any particular number of cavities. Accordingly, any number of cavities may be included in the MCRBOP without departing from the scope of the present disclosure. Similarly, any desired number and type of rams may be implemented in conjunction with an MCRBOP in accordance with illustrative embodiments of the present disclosure.

Further, the present disclosure is not limited to any particular number of offsets. Accordingly, any number of angular offsets may be implemented between the cavities without departing from the scope of the present disclosure. Specifically, any multi-axis offset arrangement may be used. For instance, in certain implementations, a second cavity may be at a first angular offset from a first cavity and a third cavity may be at a second angular offset from the second cavity. The first angular offset and the second angular offset may be the same or may be different. In the same manner, other desirable number of angular offsets may be implemented.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present invention. Also, the terms in the claims have their plain, ordinary meaning unless otherwise explicitly and clearly defined by the patentee. The indefinite articles "a" or "an," as used in the claims, are each defined herein to mean one or more than one of the element that it introduces.

What is claimed is:

1. An improved multi-cavity ram blowout preventer comprising:

a body having a first side wall, a second side wall, a third side wall, and a fourth side wall, wherein each of the first, second, third, and fourth side walls are straight walls, wherein the first side wall is opposite the second side wall, and wherein the third side wall is opposite the fourth side wall, the body further comprising a first offset wall and a second offset wall, wherein the first and second offset walls are both straight;

a first cavity extending through both the first side wall and the second side wall;

a first pair of actuator assemblies coupled to the first cavity at the first side wall and the second side wall;

a second cavity extending through both the third side wall and the fourth side wall, wherein the second cavity is disposed adjacent to the first cavity;

a second pair of actuator assemblies coupled to the second cavity at the third side wall and the fourth side wall;

wherein the second cavity is disposed at an angular offset from the first cavity; and wherein the first cavity and the second cavity are disposed adjacent to each other at a first corner of the body, wherein the first side wall and the third side wall directly meet at the first corner;

wherein the first cavity and the second cavity are disposed adjacent to each other at a second corner of the body, wherein the second side wall and the fourth side wall directly meet at the second corner;

wherein the first cavity and the second cavity are spaced apart by the first offset wall of the body disposed directly between the first and fourth side walls at a third corner of the body; and wherein the first cavity and the second cavity are spaced apart by the second offset wall of the body disposed directly between the second and third side walls at a fourth corner of the body.

2. The improved multi-cavity ram blowout preventer of claim 1, further comprising a first ram guide chamber coupled to the first cavity and a second ram guide chamber coupled to the second cavity.

3. The improved multi-cavity ram blowout preventer of claim 1, further comprising a first set of connections associated with the first cavity and a second set of connections associated with the second cavity.

4. The improved multi-cavity ram blowout preventer of claim 3, wherein the first pair of actuator assemblies is coupled to the first set of connections and the second pair of actuator assemblies is coupled to the second set of connections.

5. The improved multi-cavity ram blowout preventer of claim 3, further comprising a bore extending through the first cavity and the second cavity.

6. The improved multi-cavity ram blowout preventer of claim 5, wherein at least one connection of the first set of connections and at least one connection of the second set of connections are disposed at the same axial location along the bore.

7. The improved multi-cavity ram blowout preventer of claim 1, wherein the angular offset is in a range of from approximately 30° to approximately 90°.

8. The improved multi-cavity ram blowout preventer of claim 1, wherein the angular offset is in a range of from approximately 30° to approximately 90°.

9. An improved multi-cavity ram blowout preventer comprising:

a body having a first side wall, a second side wall, a third side wall, and a fourth side wall, wherein each of the first, second, third, and fourth side walls are straight walls, wherein the first side wall is opposite the second side wall, and wherein the third side wall is opposite the fourth side wall;

a first cavity extending through both the first side wall and the second side wall;

a first pair of actuator assemblies coupled to the first cavity;

a second cavity extending through both the third side wall and the fourth side wall and disposed at an angular offset from the first cavity;

a second pair of actuator assemblies coupled to the second cavity;

a third cavity extending through both the first side wall and the second side wall, wherein the third cavity is in angular alignment with the first cavity;

a third pair of actuator assemblies coupled to the third cavity;

a fourth cavity extending through both the third side wall and the fourth side wall and disposed at an angular offset from the first and third cavities; and a fourth pair of actuator assemblies coupled to the fourth cavity.

10. The improved multi-cavity ram blowout preventer of claim 9, further comprising;

a first offset wall disposed between the first cavity and the second cavity, the first offset wall also being disposed between the third cavity and the fourth cavity, wherein the first offset wall is a straight wall connecting the first and fourth side walls, while the first and third side walls are directly connected to each other; and a second offset wall disposed between the first cavity and the second cavity, the second offset wall being disposed between the third cavity and the fourth cavity, wherein the second offset wall is a straight wall connecting the second and third side walls, while the second and fourth side walls are directly connected to each other.

11. The improved multi-cavity ram blowout preventer of claim 9, further comprising a first pair of ram guide chambers coupled to the first cavity, a second pair of ram guide chambers coupled to the second cavity, a third pair of ram guide chambers coupled to the third cavity, and a fourth pair of ram guide chambers coupled to the fourth cavity.

12. The improved multi-cavity ram blowout preventer of claim 9, further comprising a first set of connections associated with the first cavity, a second set of connections associated with the second cavity, a third set of connections associated with the third cavity, and a fourth set of connections associated with the fourth cavity.

13. The improved multi-cavity ram blowout preventer of claim 12, wherein the first pair of actuator assemblies are coupled to the first set of connections and the second pair of actuator assemblies are coupled to the second set of connections.

14. The improved multi-cavity ram blowout preventer of claim 12, further comprising a bore extending through the first, second, third, and fourth cavities.

15. The improved multi-cavity ram blowout preventer of claim 14, wherein at least one connection of the first set of connections and at least one connection of the second set of connections are disposed at the same axial location along the bore, wherein at least one connection of the second set of connections and at least one connection of the third set of connections are disposed at the same axial location along the bore, and wherein at least one connection of the third set of connections and at least one connection of the fourth set of connections are disposed at the same axial location along the bore.

16. The improved multi-cavity ram blowout preventer of claim 9, further comprising a first set of rams coupled to the first pair of actuator assemblies, a second set of rams coupled to the second pair of actuator assemblies, a third set of rams coupled to the third pair of actuator assemblies, and a fourth set of rams coupled to the fourth pair of actuator assemblies, wherein one set of rams of the first, second, third, and fourth sets of rams comprise shear rams, and the other three sets of rams comprise pipe rams.

* * * * *